US007540054B2

(12) United States Patent
Goldstein

(10) Patent No.: US 7,540,054 B2
(45) Date of Patent: Jun. 2, 2009

(54) COMBINATION TOOTHBRUSH AND PIVOTABLE TONGUE SCRAPER

(76) Inventor: Glen M. Goldstein, 16 E. Cove La., Morristown, NJ (US) 07960

( * ) Notice: Subject to any disclaimer, the term of this patent is extended or adjusted under 35 U.S.C. 154(b) by 125 days.

(21) Appl. No.: 11/703,849

(22) Filed: Feb. 8, 2007

(65) Prior Publication Data

US 2008/0189889 A1 Aug. 14, 2008

(51) Int. Cl.
*A47L 13/02* (2006.01)
*A61B 17/24* (2006.01)

(52) U.S. Cl. ..... 15/111; 15/167.1; 15/236.01; 15/236.06; 15/236.08; D4/108; D4/112; D4/118; D24/146; D24/154

(58) Field of Classification Search ..... 15/111, 15/236.01, 236.06, 236.08, 167.1; D4/108, D4/112, 118; D24/146, 154; *A47L 13/02; A61B 17/24*
See application file for complete search history.

(56) References Cited

U.S. PATENT DOCUMENTS 1,741,143 A * 12/1929 Chin ..... 606/161

* cited by examiner

*Primary Examiner*—David A Redding
(74) *Attorney, Agent, or Firm*—Donald W. Meeker

(57) ABSTRACT

A multiple ridge tongue scraper the width of the tongue is pivotally attached to a recessed portion on an end of a toothbrush opposite the brush end. A pair of protrusions are positioned on the bottom of the tongue scraper with one on each side of the pivot pin. The pair of tongue scraper protrusions snap into a pair of mating lateral dents, one on each lateral side of the pivot pin to lock the tongue scraper at a right angle to the handle for use as a tongue scraper. The pair of tongue scraper protrusions snap into a pair of mating longitudinal dents, one on each longitudinal side of the pivot pin to lock the tongue scraper into alignment with the handle for use as a toothbrush.

6 Claims, 3 Drawing Sheets

COMBINATION TOOTHBRUSH AND PIVOTABLE TONGUE SCRAPER

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to combined brushes and scrapers and particularly to a toothbrush having a conventional toothbrush bristles at a first end of a handle and a tongue scraper pivotally mounted to a second end of the handle; the tongue scraper may be pivoted in alignment with the handle for storage or perpendicular to the handle for use, each position is held by a system of projections on the tongue scraper and mating dimples in the handle.

2. Description of Related Art including information disclosed under 37 CFR 1.97 and 1.98

Bad breath is caused by bacteria, dead tissue, and food debris in the mouth, and unless removed, they will mix with saliva to form plaque. Plaque is harmful to the teeth and gums and also causes mouth odors which are often a great cause of embarrassment to the individual suffering from them.

Prior art devices for combined toothbrushes and tongue scrapers generally build the tongue scraper into the handle thereby providing narrow tongue scrapers requiring repeated passes over the tongue to scrape the entire tongue surface and generally wider or pivoting handles with scrapers protrude from the handle and do not provide a smooth handle for using the brush end of the toothbrush.

U.S. Pat. No. 1,741,143, issued Dec. 31, 1929 to Chin, provides a tongue scraper and tooth brush combination. The tongue scraper is pivotally secured to the end of tooth brush handle opposite the brush end. The tongue scraper may be pivoted in alignment with the handle when not in use or perpendicular to the handle for use.

U.S. Pat. No. 1,658,706, issued Feb. 7, 1928 to Carrott, is for a combined toothbrush and tongue scraper. In an alternate embodiment, a folding toothbrush handle is provided with toothbrush bristles on a first member thereof and tongue scraper on a second member thereof. The handle may be folded for storage or extended for use. The tongue scraper member has a V-shaped ridge which mates with V-shaped depressions in the toothbrush member to hold the handle in either a folded or extended position.

U.S. Pat. No. D377,417, issued Jan. 21, 1997 to Gupta, describes the ornamental design for a combined tongue cleaner and toothbrush, which has tongue cleaning ridges molded into a cross member at the end of the toothbrush handle.

U.S. Patent Application #20050016561, published Jan. 27, 2005 by Sexson, illustrates a folding, disposable toothbrush. In an alternative embodiment of the invention, the toothbrush includes dental floss, a toothpick, and a tongue scraper U.S. Pat. No. 2,708,762, issued May 24, 1955 to Kling, shows an oral instrument including a toothbrush at one end, a pad including rubber massaging fingers at the other end thereof, and a tapered tongue scraper blade pivotally mounted in between.

U.S. Pat. No. D354,624, issued Jan, 24, 1995 to Gupta, claims the ornamental design for a combined tongue cleaner and toothbrush, which has tongue cleaning ridges molded into the handle of the toothbrush.

U.S. Pat. No. 6,647,581, issued Nov. 18, 2003 to Persad, discloses a tongue cleaner being fitted into a hollow opening inside the handle of a toothbrush. It is very accessible from the handle like a pocket knife. The material of the tongue cleaner is made of plastic, 0.5 mm in thickness, about 12 cm long, and 1 cm in width. The material can be easily bent in a v-shape pattern because in the center of the tongue cleaner there is a slight depression of 1 mm in the width of the material.

Two U.S. Pat. No. 5,881,422 issued Mar. 16, 1999 and U.S. Pat. No. 5,913,346 issued Jun. 22, 1999 both to Narwani, indicate a folding tongue cleaning device used to scrape the tongue to remove bacteria, tongue debris and film and other particular matter from the tongue. It can be easily rinsed and reused, and, because it is manufactured from plastic, is easy and inexpensive to manufacture.

U.S. Pat. No. 5,530,981, issued Jul. 2, 1996 to Chen, puts forth a toothbrush having a scraper disposed therein. The toothbrush includes a handle and a bristle portion which has a barrel connected therewith and is pivotally engaged to the handle with a cylinder disposed to the barrel pivotally engaged between two ears extending from an end of the handle, the handle having a groove defined in a side thereof for the scraper to be inserted therein, each of the ears having a first recess defined therein and the cylinder having a plurality of short grooves defined in both ends thereof, the scraper having a first end and having two parts extending therefrom for insertion into said short grooves, a hook portion formed to one of the parts laterally and engaged with the first recess of the ear, the scraper having a T-shaped plate slidably received in the groove of the handle.

U.S. Pat. No. 5,810,856, issued Sep. 22, 1998 to Tveras, concerns a toothbrush combined with a wiping or scraping device, particularly for cleaning a human tongue, having one or more wiping teeth or wiping elements. Each tooth or element has at least one scoop-like side which terminates at a wiping edge or ridge in an undercutting fashion. Various embodiments are provided for providing bi-directional or planar-directional wiping or cleaning action. For example, embodiments of the invention include wiping devices, linear wiping elements or circular wiping elements with outwardly-directed and/or inwardly-directed annular wiping edges. The wiping device may include a plurality of wiping elements arranged in a row or array.

U.S. Pat. No. 6,546,583, issued Apr. 15, 2003 to Rohrig, illustrates a toothbrush comprising a handle at one end of which a bristle portion is provided for cleaning the teeth, and a massaging portion at the opposite end of the handle. The massaging portion may be raised transverse webs that can alternately be used as a tongue scraper.

U.S. Pat. No. D390,008, issued Feb. 3, 1998 to Blosser, is for the ornamental design for a toothbrush with water activated paste. The toothbrush has transverse raised ridges across the end of its handle.

What is needed is a combined toothbrush and tongue scraper with a pivoting tongue scraper which pivots out and locks in an operative position with a wide scraper having a series of scraping ridges perpendicular to the brush handle providing a tongue scraper substantially the width of a tongue of a user and pivot back and locks into alignment with the toothbrush handle resting within a recessed space in the toothbrush handle so that a user has a uniformly sized handle throughout its length for ease of use of the bush portion for brushing the teeth.

BRIEF SUMMARY OF THE INVENTION

An object of the present invention is to provide a combined toothbrush and tongue scraper with a pivoting tongue scraper which pivots out and locks in an operative position with a wide scraper having a series of scraping ridges perpendicular to the brush handle providing a tongue scraper substantially the width of a tongue of a user so that a multiple scraping of the entire tongue occurs with a single pass of the tongue scraper and the tongue scraper pivots back and locks into alignment with the toothbrush handle resting within a recessed space in the toothbrush handle so that a user has a uniformly sized handle throughout its length for ease of use of the brush portion for brushing the teeth and to enable the invention to fit into a standard size toothbrush holder.

Another object of the present invention is that the ridges of the tongue scraper are structured at a downward angle not straight up to provide maximum efficiency in scraping the tongue.

In brief, a multiple ridge tongue scraper the width of the tongue is pivotally attached to a recessed portion on an end of a toothbrush opposite the brush end. A pivot pin allows the tongue scraper to pivot out to a first position at a right angle to the handle for use as a scraper and pivot back into a second position in alignment with the handle for use as a toothbrush. A pair of tongue scraper protrusions are positioned on the bottom of the tongue scraper with one on each side of the pivot pin. The pair of tongue scraper protrusions snap into a pair of mating lateral dents, one on each lateral side of the pivot pin to lock the tongue scraper in the first right angle position for use as a tongue scraper. The pair of tongue scraper protrusions snap into a pair of mating longitudinal dents, one on each longitudinal side of the pivot pin to lock the tongue scraper in the second aligned position for use as a toothbrush.

An advantage of the present invention is that it provides a combined toothbrush and tongue scraper with a wide multiple-blade scraper for a multiple scraping of the entire tongue with a single pass of the tongue scraper.

Another advantage of the present invention is that the tongue scraper pivots back into alignment with the handle in a recessed portion of the handle to allow normal use of the handle for brushing the teeth.

One more advantage of the present invention is that when the tongue scraper is pivoted into alignment with the handle it will fit into a common bathroom toothbrush holder.

Another advantage of the present invention is that the tongue scraper provides maximum efficiency in scraping the tongue.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
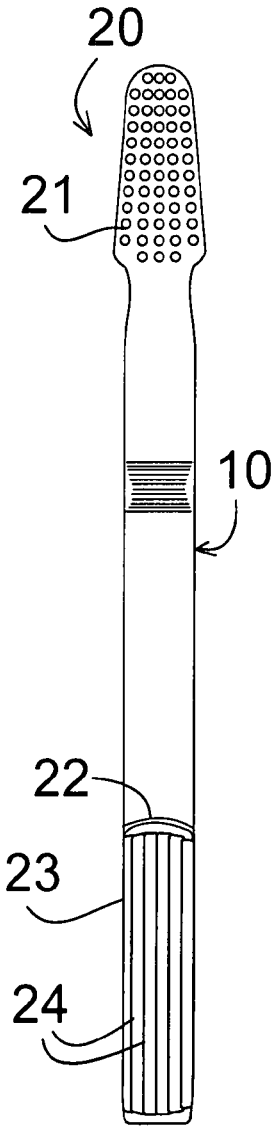
FIG. 1 is a top plan view of the combination tooth brush and tongue scraper of the present invention showing the tongue scraper aligned with the toothbrush handle ready for use as a toothbrush.

In FIGS. 1-7, a combined toothbrush and tongue scraper device 20 comprises a toothbrush with normal tooth brushing bristles 21 and a pivotable tongue scraper 23 in a recessed portion 22 of the handle 10 at an opposite end to the bristles.

The toothbrush 20 comprising an elongated handle 10 with bristles 21 at a first end for brushing the teeth of a user and a recessed portion 22 along one side of a second end of the handle.

Figure 2:
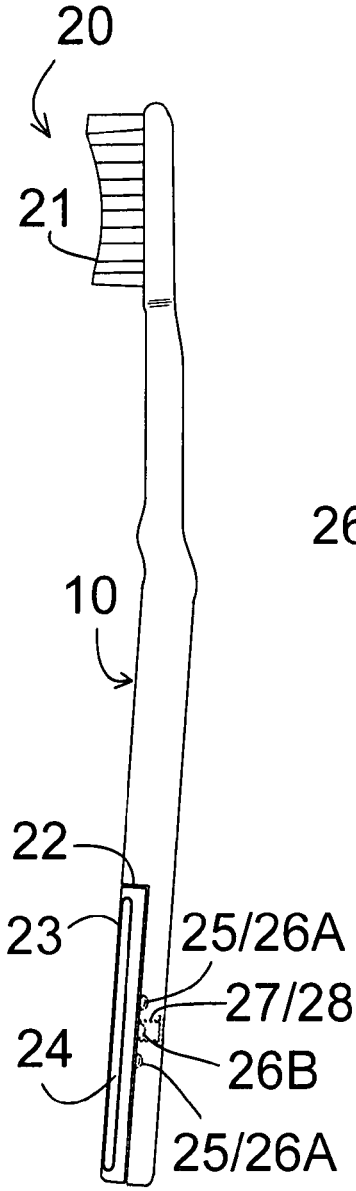
FIG. 2 is a side elevational view of the combination tooth brush and tongue scraper of FIG. 1 showing the tongue scraper aligned with the toothbrush handle.
Figure 3:
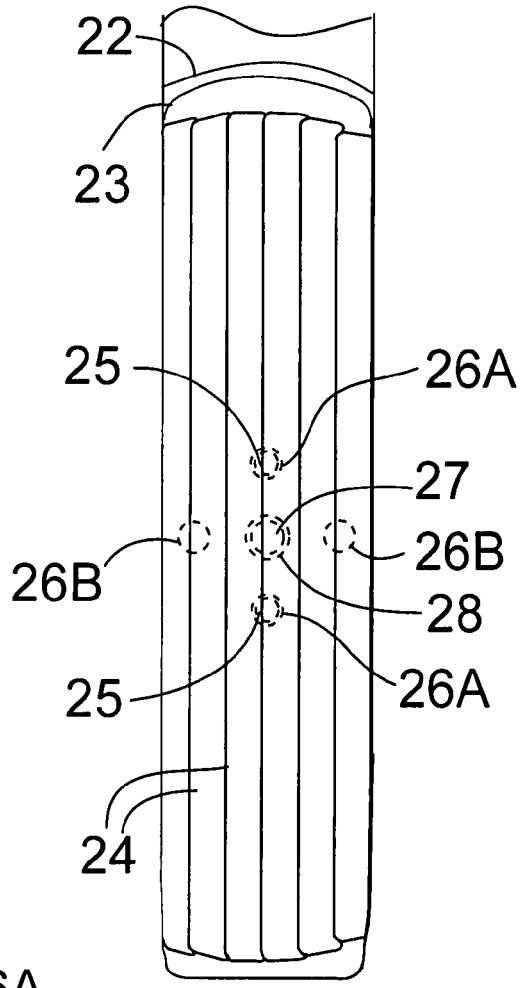
FIG. 3 is an exploded partial top plan view of the combination tooth brush and tongue scraper of FIG. 1 showing the tongue scraper aligned with the toothbrush handle ready for use as a toothbrush and showing in dashed lines the two tongue scraper protrusions in the two longitudinal toothbrush handle dents, the two lateral toothbrush handle dents, and the tongue scraper pivot pin in the toothbrush handle opening.
Figure 4:
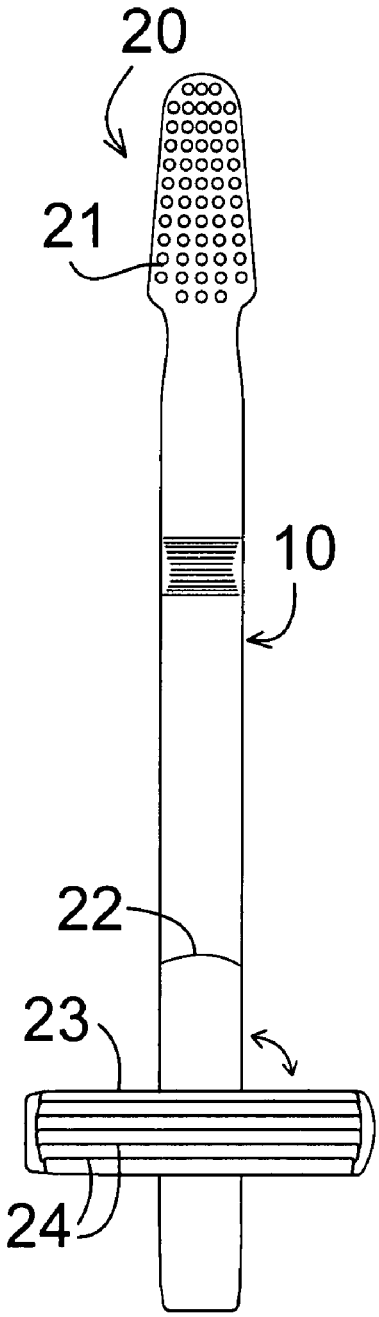
FIG. 4 is a top plan view of the combination tooth brush and tongue scraper of the present invention showing the tongue scraper pivoted at a right angle to the toothbrush handle ready for use as a tongue scraper.
Figure 5:
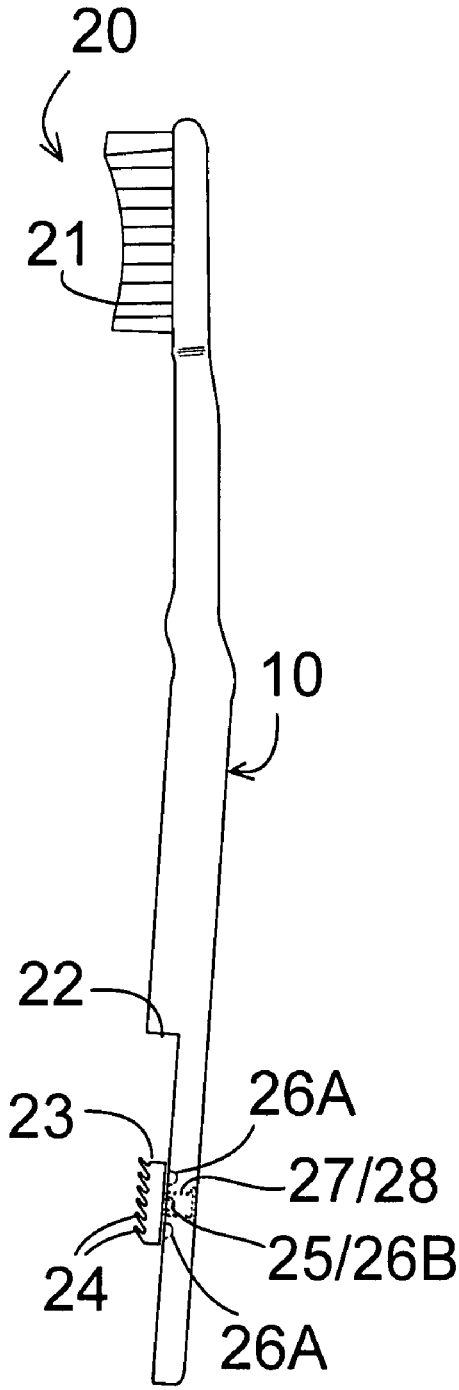
FIG. 5 is a side elevational view of the combination tooth brush and tongue scraper of FIG. 4 showing the tongue scraper pivoted at a right angle to the toothbrush handle and showing the series of tongue scraping ridges of the tongue scraper.
Figure 6:
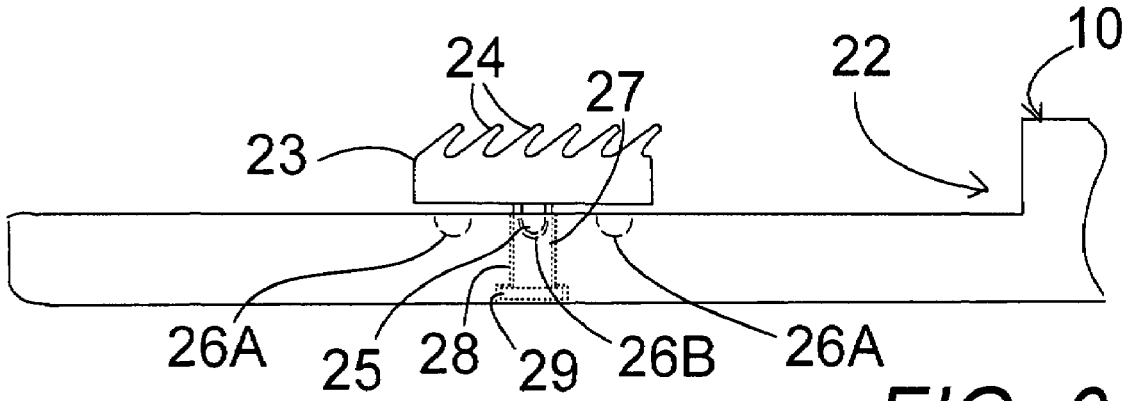
FIG. 6 is an exploded partial side elevational view of the combination tooth brush and tongue scraper of FIG. 4 showing the tongue scraper pivoted at a right angle to the toothbrush handle and showing the series of tongue scraping ridges of the tongue scraper, the pivot pin, and showing in dashed lines one of the tongue scraper protrusions in one of the lateral toothbrush handle dents, the two longitudinal toothbrush handle dents, and the toothbrush scraper pivot pin in the toothbrush handle pivot opening.
Figure 7:
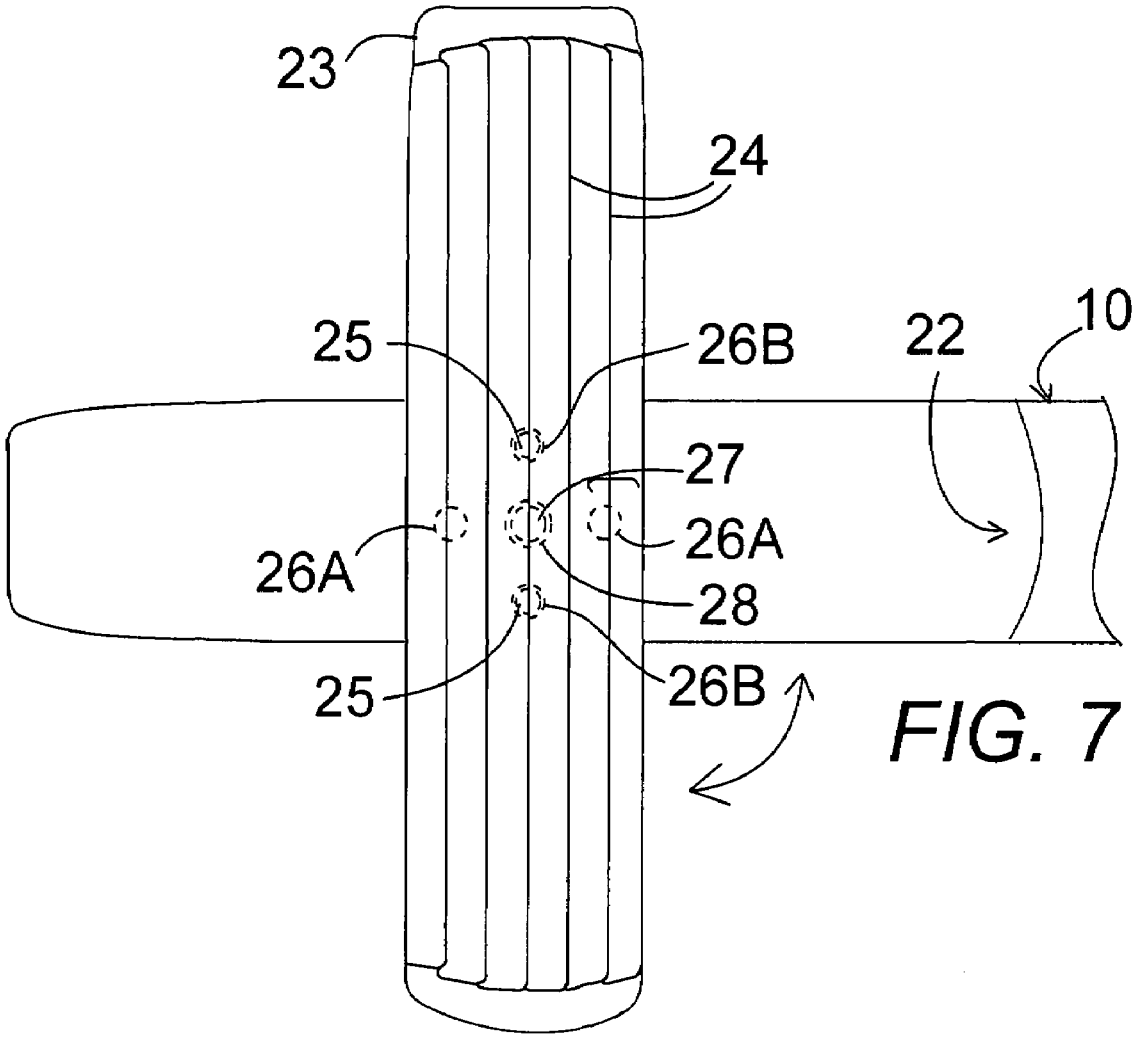
FIG. 7 is an exploded partial top plan view of the combination tooth brush and tongue scraper of FIG. 4 showing the tongue scraper pivoted at a right angle to the toothbrush handle ready for use as a tongue scraper and showing in dashed lines the two tongue scraper protrusions in the two lateral toothbrush handle dents, the two longitudinal toothbrush handle dents, and the tongue scraper pivot pin in the toothbrush handle opening.

A pivoting tongue scraper 23 attached within the recessed portion 22 of the handle 10 by a means for pivoting the tongue scraper 23 into a first position perpendicular to the handle for scraping the tongue of a user, as shown in FIGS. 4-7, and pivoting the tongue scraper 23 into a second position in parallel alignment with the handle 10 with the tongue scraper fitting within the recessed portion 22 for brushing the teeth, as shown in FIGS. 1-3. The means for pivoting the tongue scraper preferably comprises a pivot pin 27 between the handle 10 and the tongue scraper 23 preferably with the pivot pin 27 extending from the tongue scraper 23 and pivotally inserted in a toothbrush handle pivot opening 28 which may have a cap 29 to retain the pivot pin 27 in the pivot opening 28, as shown in FIGS. 6 and 7.

A means for locking the tongue scraper in the first position of FIGS. 4-7 and means for alternately locking the tongue scraper in the second position of FIGS. 1-3. preferably comprises a pair of tongue scraper protrusions 25 positioned in alignment along the length of the tongue scraper on each side of the pivot pin 27 which alternately snap lock into lateral dents 26B across the width of the recessed portion 22 of the handle on each lateral side of the pivot pin opening 28 as a means of locking the tongue scraper in the first position shown in FIGS. 5-7; and the tongue scraper protrusions alternately snap lock into longitudinal dents 26A along the length of the recessed portion 22 of the handle on each longitudinal side of the pivot pin opening 28 as a means of locking the tongue scraper in the second position shown in FIGS. 2 and 3.

The tongue scraper 23 comprises a length sufficient to span the width of the tongue of the user and a series of scraping ridges 24 perpendicular to the brush handle in the first position of FIGS. 4-7 for a multiple scrape of the entire width of the tongue with a single pass of the tongue scraper over the tongue and the tongue scraper 23 alternately locks in the second position in the recessed portion 22 of the handle 10 within the outline of the toothbrush handle 10 so that the tongue scraper does not interfere with a user gripping the handle 10 to brush the teeth of the user. The ridges 24 of the tongue scraper are angled downwardly in the direction of travel of the tongue scraper over the tongue for maximum efficiency in scraping the tongue.

The parts of the combined toothbrush and tongue scraper may be fabricated by molding synthetic material.

It is understood that the preceding description is given merely by way of illustration and not in limitation of the invention and that various modifications may be made thereto without departing from the spirit of the invention as claimed.

SEQUENCE LISTING

Not Applicable

What is claimed is:

1. A combined toothbrush and tongue scraper device comprising in combination:

a toothbrush comprising an elongated handle with bristles at a first end for brushing the teeth of a user and a recessed portion along one side of a second end;

a pivoting tongue scraper attached within the recessed portion by a means for pivoting the tongue scraper into a first position perpendicular to the handle for scraping the tongue of a user and pivoting the tongue scraper into a second position in parallel alignment with the handle with the tongue scraper fitting within the recessed portion for brushing the teeth; and means for locking the tongue scraper in the first position and means for alternately locking the tongue scraper in the second position; the tongue scraper comprising a length sufficient to span the width of the tongue of the user and a series of scraping ridges perpendicular to the brush handle in the first position for a multiple scrape of the entire width of the tongue with a single pass of the tongue scraper over the tongue in a tongue scraper which further locks in the second position within the outline of the toothbrush handle so that the tongue scraper does not interfere with a user gripping the handle to brush the teeth of the user.

2. The device of claim 1 wherein the means for pivoting the tongue scraper comprises a pivot pin between the handle and the tongue scraper.

3. The device of claim 2 wherein the means for locking the tongue scraper in the first position comprises a first pair of dents positioned across the width of the handle within the recessed portion of the handle on each of two sides of the pivot pin and a pair of tongue scraper protrusions along the length of the tongue scraper with one on each side of the pivot pin, the tongue scraper protrusions mating with the first pair of dents so that the pair of tongue scraper protrusions snap into the pair of first dents to lock the tongue scraper into the first position and the means for locking the tongue scraper in the second position comprises a second pair of dents positioned along the length of the handle within the recessed portion of the handle across the width of the handle on each of two sides of the pivot pin, the pair of tongue scraper protrusions mating with the second pair of dents with the pair of tongue scraper protrusions snapping into the second pair of dents to lock the tongue scraper in the second position.

4. The device of claim 1 wherein the scraping ridges are angled downwardly in a direction of travel over the tongue to scrape efficiently.

5. A combined toothbrush and tongue scraper device comprising in combination:

a toothbrush comprising an elongated handle with bristles at a first end for brushing the teeth of a user and a recessed portion along one side of a second end;

a pivoting tongue scraper attached within the recessed portion by a means for pivoting the tongue scraper into a first position perpendicular to the handle for scraping the tongue of a user and pivoting the tongue scraper into a second position in parallel alignment with the handle with the tongue scraper fitting within the recessed portion for brushing the teeth, wherein the means for pivoting the tongue scraper comprises a pivot pin between the handle and the tongue scraper; and means for locking the tongue scraper in the first position and means for alternately locking the tongue scraper in the second position; the tongue scraper comprising a length sufficient to span the width of the tongue of the user and a series of scraping ridges perpendicular to the brush handle in the first position for a multiple scrape of the entire width of the tongue with a single pass of the tongue scraper over the tongue in a tongue scraper which further locks in the second position within the outline of the toothbrush handle so that the tongue scraper does not interfere with a user gripping the handle to brush the teeth of the user.

6. A combined toothbrush and tongue scraper device comprising in combination:

a toothbrush comprising an elongated handle with bristles at a first end for brushing the teeth of a user and a recessed portion along one side of a second end;

a pivoting tongue scraper attached within the recessed portion by a means for pivoting the tongue scraper into a first position perpendicular to the handle for scraping the tongue of a user and pivoting the tongue scraper into a second position in parallel alignment with the handle with the tongue scraper fitting within the recessed portion for brushing the teeth; and means for locking the tongue scraper in the first position and means for alternately locking the tongue scraper in the second position; the tongue scraper comprising a length sufficient to span the width of the tongue of the user and a series of scraping ridges perpendicular to the brush handle in the first position for a multiple scrape of the entire width of the tongue with a single pass of the tongue scraper over the tongue in a tongue scraper which further locks in the second position within the outline of the toothbrush handle so that the tongue scraper does not interfere with a user gripping the handle to brush the teeth of the user, wherein the scraping ridges are angled downwardly in a direction of travel over the tongue to scrape efficiently.

* * * * *